US012759109B2

(12) United States Patent
Guglielmetti et al.

(10) Patent No.: US 12,759,109 B2
(45) Date of Patent: Oct. 13, 2026

(54) BACKFLOW DIVERSION DEVICES FOR LIQUID JET CUTTING SYSTEMS, AND ASSOCIATED SYSTEMS AND METHODS

(71) Applicant: OMAX Corporation, Kent, WA (US)

(72) Inventors: Brian K. Guglielmetti, Bonney Lake, WA (US); Manases Dumlao, Federal Way, WA (US)

(73) Assignee: Hypertherm, Inc., Hanover, NH (US)

( * ) Notice: Subject to any disclaimer, the term of this patent is extended or adjusted under 35 U.S.C. 154(b) by 792 days.

(21) Appl. No.: 18/069,143

(22) Filed: Dec. 20, 2022

(65) Prior Publication Data

US 2023/0191561 A1 Jun. 22, 2023

Related U.S. Application Data

(60) Provisional application No. 63/291,707, filed on Dec. 20, 2021.

(51) Int. Cl.
*B24C 7/00* (2006.01)
*B24C 1/04* (2006.01)

(52) U.S. Cl.
CPC ..... *B24C 7/003* (2013.01); *B24C 1/045* (2013.01)

(58) Field of Classification Search
CPC ..... B05B 1/28; B24C 7/0069; B24C 7/003; B24C 5/04; B24C 3/22
USPC ..... 137/115.01; 451/38; 222/318
See application file for complete search history.

(56) References Cited

U.S. PATENT DOCUMENTS

| | | | | |
|---|---|---|---|---|
| 5,643,058 | A * | 7/1997 | Erichsen | B24C 7/0069 451/100 |
| 9,884,403 | B2 * | 2/2018 | Maurer | B24C 1/045 |
| 2019/0084125 | A1 * | 3/2019 | Nambiath | B24C 7/0053 |
| 2024/0075540 | A1 * | 3/2024 | Ellsworth | F28D 15/0233 |

* cited by examiner

*Primary Examiner* — Monica S Carter
*Assistant Examiner* — Caleb Andrew Holizna
(74) *Attorney, Agent, or Firm* — Ashurst Perkins Coie US LLP

(57) ABSTRACT

A device for providing abrasive to a cutting head in a liquid jet cutting system can include an abrasive inlet configured to receive abrasive from an abrasive source, an abrasive outlet downstream from the abrasive inlet and configured to provide the abrasive to the cutting head, and a backflow diverter configured to discharge backflow from the device. In some embodiments, the backflow diverter can be configured to discharge a first portion of the backflow from the device, and device can further include one or more spillways configured to discharge a second portion of the backflow from the device. The one or more spillways can be positioned upstream from the backflow diverter and/or downstream from the abrasive inlet. The backflow diverter and/or the spillways can at least partially or fully prevent the backflow from flowing upstream through the abrasive inlet and/or into the abrasive source.

31 Claims, 6 Drawing Sheets

BACKFLOW DIVERSION DEVICES FOR LIQUID JET CUTTING SYSTEMS, AND ASSOCIATED SYSTEMS AND METHODS

CROSS-REFERENCE TO RELATED APPLICATION(S)

The present application claims priority to U.S. Provisional Pat. App. No. 63/291,707, filed Dec. 20, 2021, the entirety of which is incorporated herein by reference.

TECHNICAL FIELD

The present technology is generally directed toward liquid jet cutting systems and, more particularly, toward backflow diversion devices for liquid jet cutting systems, and associated systems and methods.

BACKGROUND

Liquid jet cutting systems are used in precision cutting, shaping, carving, reaming, and other material processing applications. During operation of a liquid jet system, a cutting head directs a high-velocity jet of liquid carrying particles of abrasive material toward a workpiece to rapidly erode portions of the workpiece. Liquid jet processing has significant advantages over other material processing technologies (e.g., grinding, plasma-cutting, etc.). For example, liquid jet systems tend to produce relatively fine and clean cuts without heat-affected zones around the cuts. Liquid jet systems also tend to be highly versatile with respect to the material type of the workpiece. The range of materials that can be processed using liquid jet systems includes very soft materials (e.g., rubber, foam, leather, and paper) as well as very hard materials (e.g., stone, ceramic, and hardened metal). Furthermore, in many cases, liquid jet systems are capable of executing demanding material processing operations while generating little or no dust, smoke, or other potentially toxic airborne byproducts.

Occasionally, however, the cutting head may clog during operation, such as from inadvertent contact between the cutting head and the workpiece. This can result in backflow of abrasive, liquid, and/or steam flowing upstream through the cutting head, toward and/or into an abrasive source. Backflow that enters the abrasive source can contaminate (e.g., wet) the abrasive contained therein, which can clog the abrasive outlet from the source and/or otherwise render the liquid jet system inoperable. To return the liquid jet system to operation, the liquid jet system is typically shut down and the abrasive source cleaned out. This can be a time-consuming process during which the liquid jet system is unavailable for use.

To reduce or prevent clogs, some liquid jet systems employ a vacuum valve (e.g., a one way valve) configured to close when abrasive flow stops. The vacuum valve is intended to stop backflow from traveling further upstream from the cutting head and/or into the abrasive source. Other systems may use a backflow sensor block to measure vacuum pressures in an abrasive feedline and an air cylinder/solenoid to close the abrasive feedline and open backflow vents if the sensors detect a clog. While these approaches may limit backflow and protect the abrasive source from contamination in some instances, they are expensive, complicated to setup and calibrate, and typically require cleaning, testing, and recalibrating after backflow events, additional steps that can further increase machine downtime.

DETAILED DESCRIPTION

Figure 1:
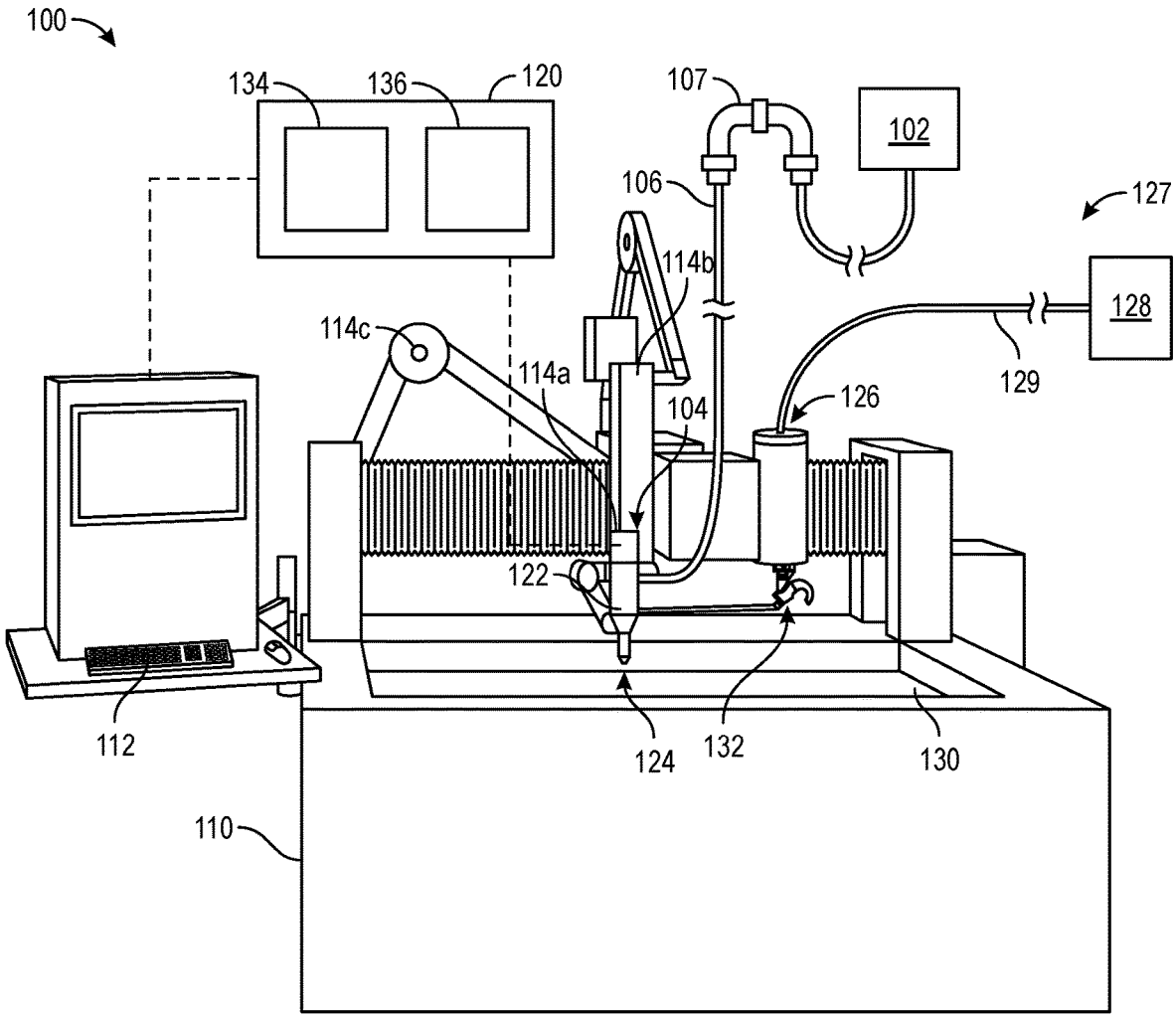
FIG. 1 is a perspective and partially schematic view of a liquid jet cutting system configured in accordance with embodiments of the present technology.

The following disclosure describes various embodiments of devices, systems and methods for preventing or reducing clogs in abrasive feed systems used with liquid jet cutting systems. Embodiments of abrasive feed systems configured in accordance with the present disclosure can generally include an abrasive feed block having an abrasive inlet configured to receive abrasive from an abrasive source, an abrasive outlet downstream from the abrasive inlet configured to provide the abrasive to a cutting head of the liquid jet cutting system, and a backflow diverter. The backflow diverter can include a backflow inlet and a backflow outlet. The backflow inlet can be positioned downstream of the abrasive inlet and upstream of the abrasive outlet, and can be configured to receive backflow, including, e.g., abrasive, liquid, and/or steam, flowing away from the abrasive outlet in a first direction. The backflow outlet can be configured to discharge the backflow away from the backflow diverter in a second direction, different than the first direction. In some embodiments, the backflow diverter can be configured to discharge a first portion of the backflow, and the abrasive feed block can further include one or more spillways configured to discharge a second portion of the backflow. The spillways can be positioned upstream from the backflow diverter and/or downstream from the abrasive inlet. As described below, the backflow diverter and/or the spillways can prevent, or at least partially prevent, the backflow from flowing upstream through the abrasive inlet and into the abrasive source, which can contaminate the abrasive and lead to clogging of the abrasive source. This, in turn, is expected to reduce the time associated with clearing clogs in the abrasive source and/or returning the liquid jet cutting system to operating condition.

Specific details of liquid jet systems and associated backflow diversion devices, systems, and methods configured in accordance with several embodiments of the present technology are disclosed herein with reference to FIGS. 1-3B. Although the devices, systems, and methods may be disclosed herein primarily or entirely with respect to certain liquid jet cutting applications, other applications in addition to those disclosed herein are within the scope of the present technology. Furthermore, it should be understood, in general, that other devices, systems, and methods, including other abrasive waterjet devices, systems, and methods, in addition to those disclosed herein are within the scope of the present technology. For example, devices, systems, and methods in accordance with embodiments of the present technology can have different and/or additional configurations, components, and procedures than those disclosed herein. Moreover, a person of ordinary skill in the art will understand that devices, systems, and methods in accordance with embodiments of the present technology may not include one or more of the configurations, components, and/or procedures disclosed herein without deviating from the present technology. Liquid jet systems configured in accordance with embodiments of the present technology can be used with a variety of suitable fluids, such as water, aqueous solutions, hydrocarbons, glycols, and nitrogen, and/or a variety of suitable abrasives, such as particulate abrasive, abrasive garnet, sand, and/or other appropriate abrasive materials or combinations thereof.

As used herein, the use of relative terminology, such as "about", "approximately", "substantially" and the like refer to the stated value plus or minus ten percent. For example, the use of the term "about 100" refers to a range of from 90 to 110, inclusive. In instances in which the context requires otherwise and/or relative terminology is used in reference to something that does not include a numerical value, the terms are given their ordinary meaning to one skilled in the art.

FIG. 1 is a perspective and partially schematic view of a liquid jet cutting system 100 configured in accordance with embodiments of the present technology. The system 100 can include a fluid supply assembly 102 (shown schematically). The fluid supply assembly 102 can include, for example, a fluid container, a pump, an intensifier, an accumulator, one or more valves, and/or one or more hydraulic units. The fluid supply assembly 102 can be configured to provide pressurized fluid to the system 100. In various embodiments, the system 100 uses various fluids including, e.g., liquid (e.g., water), and/or gases.

The system 100 further includes a cutting head assembly 104 operably connected to the fluid supply assembly 102 and one or more conduits 106 extending between the fluid supply assembly 102 and the cutting head assembly 104. In some embodiments, the conduit 106 includes one or more joints 107 (e.g., a swivel joint or another suitable joint having two or more degrees of freedom).

The system 100 can further include a cutting table 130 supported on a base 110 and a user interface 112. The user interface 112 can be supported by the base 110. The system 100 can include one or more actuators configured to tilt, rotate, translate, and/or otherwise move the cutting head assembly 104. For example, in some embodiments the system 100 can include a first actuator 114*a*, a second actuator 114*b*, and a third actuator 114*c* (collectively, "the actuators 114") configured to move the cutting head assembly 104 relative to the base 110 and other stationary components of the system 100, and/or to move the base 110 relative to the cutting head assembly 104 (such as a stationary liquid jet assembly). For example, the second actuator 114*b* can be configured to move the cutting head assembly 104 along a processing path (e.g., cutting path) in two or three dimensions and to tilt the cutting head assembly 104 relative to the base 110, or to tilt the base 110 relative to the cutting head assembly 104, or to tilt both. In some embodiments, the second actuator 114*b* tilts the cutting head assembly 104 in two or more dimensions. Thus, the cutting head assembly 104, or the base 110, or both, can be configured to direct a pressurized jet of fluid toward a workpiece (not shown) supported by the base 110 (e.g., held in a jig supported by the base 110) and to move relative to either the cutting head assembly 104 or the base 110, or both, while directing the jet toward the workpiece. In various embodiments, the system 100 can also be configured to manipulate the workpiece in translatory and/or rotatory motion, manipulating the jet and/or the workpiece. The base 110 can include a diffusing tray positioned beneath the cutting table 130. The diffusing tray can be configured to hold a pool of fluid positioned relative to the jig so as to diffuse the remaining energy of the jet from the cutting head assembly 104 after the jet passes through the workpiece.

The cutting head assembly 104 can include a cutting head 122 and a nozzle outlet 124. The cutting head 122 can be configured to receive fluid from the fluid supply assembly 102 via the conduit 106 at a pressure suitable for liquid jet (e.g., waterjet) processing. The cutting head 122 can include one or more components configured to condition fluid between the fluid supply assembly 102 and the nozzle outlet 124. In some embodiments, the system 100 can include multiple cutting heads 122 that can be controlled individually and can have the same or different parameters (orifice size, mixing tube size, abrasive size, abrasive type, abrasive feed rate, etc.).

The system 100 can further include an abrasive storage container 128 configured to hold one or more abrasive materials, such as particulate abrasive, abrasive garnet, sand, and/or other appropriate abrasive materials or combinations thereof (referred to collectively as "abrasive"). In some embodiments, the abrasive storage container 128 can be configured to provide abrasive to a hopper 126 via an abrasive conduit 129. The hopper 126 can be configured to provide abrasive received from the abrasive storage container 128 to a device 132 configured in accordance with the present technology, and the device 132 can be configured to provide the abrasive to the cutting head assembly 104. In some embodiments, the device 132 can be referred to as a "feed block" and for ease of reference we will refer to the device 132 as "feed block 132" hereinafter. Accordingly, in some embodiments the hopper 126, the abrasive storage container 128, and/or the abrasive conduit 129 can together define an abrasive source 127 configured to provide abrasive to the cutting head assembly 104 via the feed block 132. In some embodiments, the hopper 126 and/or the feed block 132 are configured to move with the cutting head assembly 104 relative to the base 110, or vice versa. In other embodiments, the hopper 126 and/or the feed block 132 can be configured to be stationary while the cutting head assembly 104 moves relative to the base 110. As described in greater detail below with reference to FIGS. 2A-2C, the feed block 132 can include devices and/or features configured to at least partially or fully prevent backflow from the cutting head assembly 104 (e.g., from the cutting head 122), including abrasive, liquid, and/or steam, from flowing upstream toward and/or into at least a portion of the abrasive source 127, such as the hopper 126. In at least some embodiments, for example, the feed block 132 can include a backflow diverter configured to redirect and/or discharge backflow toward the table 130 of the system 100.

The user interface 112 can be configured to receive input from a user and to send data based on the input to a computing device 120 (e.g., a controller). The input can include, for example, one or more specifications (e.g., coordinates, geometry or dimensions) of the processing path and/or one or more specifications (e.g., material type or thickness) of the workpiece and operating parameters (e.g., for a waterjet tool, pressure, flow rate, abrasive material, etc.). The computing device 120 (shown schematically) can be operably connected to the user interface 112 and one or more of the actuators 114 (e.g., via one or more cables, wireless connections, etc.). The computing device 120 can include a processor 134 and memory 136 and can be programmed with instructions (e.g., non-transitory instructions contained on a computer-readable medium) that, when executed, control operation of the system 100.

The system 100 can be configured to contain one or more independent or connected motion control units. The system can be configured in various ways that allow perpendicular, rotational and/or angular cutting of workpieces of different shape. Embodiments of the system can include but are not limited to gantry, bridge, multi-axis kinematics (similar in function to OMAX Tilt-A-Jet or A-Jet tools and Hypertherm Echion and HyPrecision systems), 6-axis robot, rotary, and hexapod style machines. In various embodiments, the system is suited to cutting workpieces of a wide variety of thicknesses, including workpieces of negligible thicknesses. In various embodiments, the system 100 is adapted to cut workpieces of a variety of three-dimensional shapes. In some embodiments, the jet can cut at any angle relative to the workpiece. It will be understood that embodiments of the backflow diversion devices and other devices, systems, and methods configured in accordance the present technology disclosed herein are not limited to use with the system 100, but can be used with a wide variety of other suitable systems. Similarly, it will be understood that the various components, features, operations, etc. of the system 100 are described herein by way of example, and that all such components, features, operations, etc. are not essential to all embodiments of the present technology.

Figure 2A:
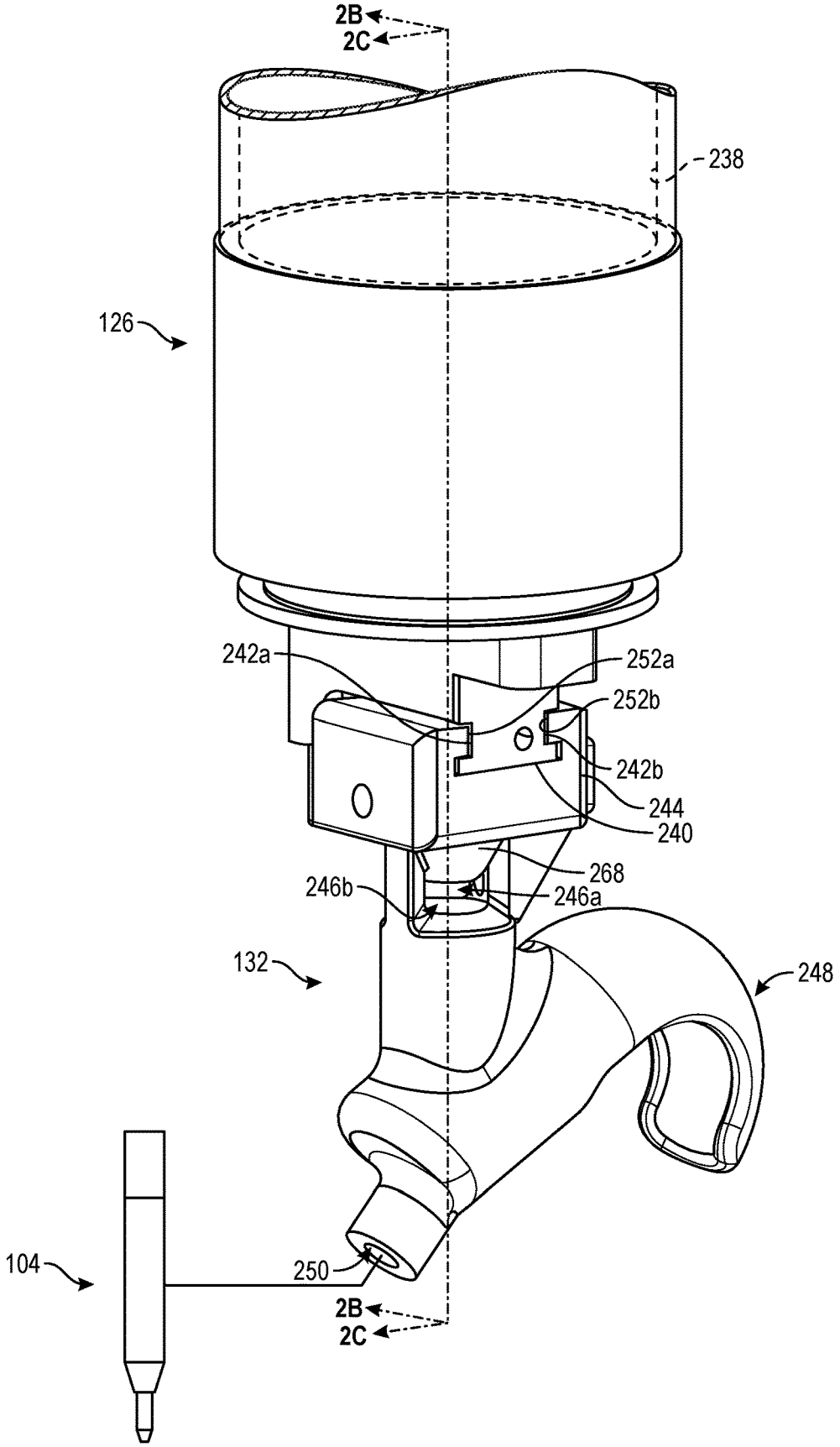
FIG. 2A is a perspective view of an abrasive feed block of the liquid jet cutting system of FIG. 1, having a backflow diverter configured in accordance with embodiments of the present technology.

FIG. 2A is a perspective view of the feed block 132 and a portion of the hopper 126 configured in accordance with embodiments of the present technology. The hopper 126 can include an internal chamber 238 and a coupling component 240. The internal chamber 238 can be configured to receive and/or hold abrasive (not shown) from the abrasive storage container 128 (FIG. 1). As described in more detail below, the coupling component 240 can be configured to releasably engage and operably couple the feed block 132 to the hopper 126.

The feed block 132 can include a coupling portion 244 configured to removably couple the feed block 132 to the hopper 126. In some embodiments, for example, the coupling portion 244 can include opposing projections or tabs 252 (identified individually as a first tab 252*a* and a second tab 252*b*), and at least a portion of each of the tabs 252 can be configured to be slidably received within a corresponding slot 242 (identified individually as a first slot 242*a* and a second slot 242*b*) on opposite sides of the coupling component 240. For example, at least a portion of the first tab 252*a* can be slidably received within the first slot 242*a* and at least a portion of the second tab 252*b* can be slidably received within the second slot 242*b*. In other embodiments, the coupling component 240 and/or the coupling portion 244 can have other configurations and/or other features for operably and removably coupling the feed block 132 to the hopper 126.

In some embodiments, the feed block 132 can further include one or more spillways 246 (identified individually as a first spillway 246*a* and a second spillway 246*b*), a backflow diverter 248, and an abrasive outlet 250. One or more of the spillways 246 can be positioned upstream of the backflow diverter 248. The abrasive outlet 250 can be operably coupled to the cutting head assembly 104 and configured to provide abrasive thereto. In other embodiments, the feed block 132 can include the backflow diverter 248 without one or both of the spillways 246, and/or in further embodiments, the feed block 132 can include one or both of the spillways 246 without the backflow diverter 248.

During operation of the liquid jet cutting system 100 (FIG. 1), backflow (including, e.g., abrasive, water and/or other liquids, and/or steam) can occasionally flow upstream from the cutting head assembly 104 (as a result of, e.g., inadvertent contact between the cutting head assembly 104 and a workpiece) and enter the feed block 132 via the abrasive outlet 250. As described in more detail below, all or at least a portion of the backflow entering the feed block 132 via the abrasive outlet 250 can be discharged from the feed block 132 via the backflow diverter 248 and/or one or more of the spillways 246 to prevent, or at least partially prevent, the backflow from entering the hopper 126. As noted above, backflow that enters the hopper 126 and/or that otherwise contacts abrasive contained therein can cause blockages and/or clogs, and cleaning the blockages/clogs can be a time-consuming process during which the system 100 is unavailable for use. Accordingly, discharging backflow via the backflow diverter 248 and/or the spillways 246 is expected to prevent or at least reduce time-consuming cleaning procedures and/or the machine downtime associated therewith. Additionally, or alternatively, because the feed block 132 is releasably coupled to the hopper 126, the feed block 132 can be removed from the hopper 126 and cleared of any backflow or other material without disassembling other portions of the system 100. Furthermore, in some embodiments, the backflow diverter 248 and/or the spillways 246 are passive elements of the feed block 132, such that the backflow diverter 248 and/or the spillways 246 can automatically discharge backflow without the use of sensors to detect backflow and/or actuators to open any valves, openings, and/or other backflow discharging apertures.

Figure 2B:
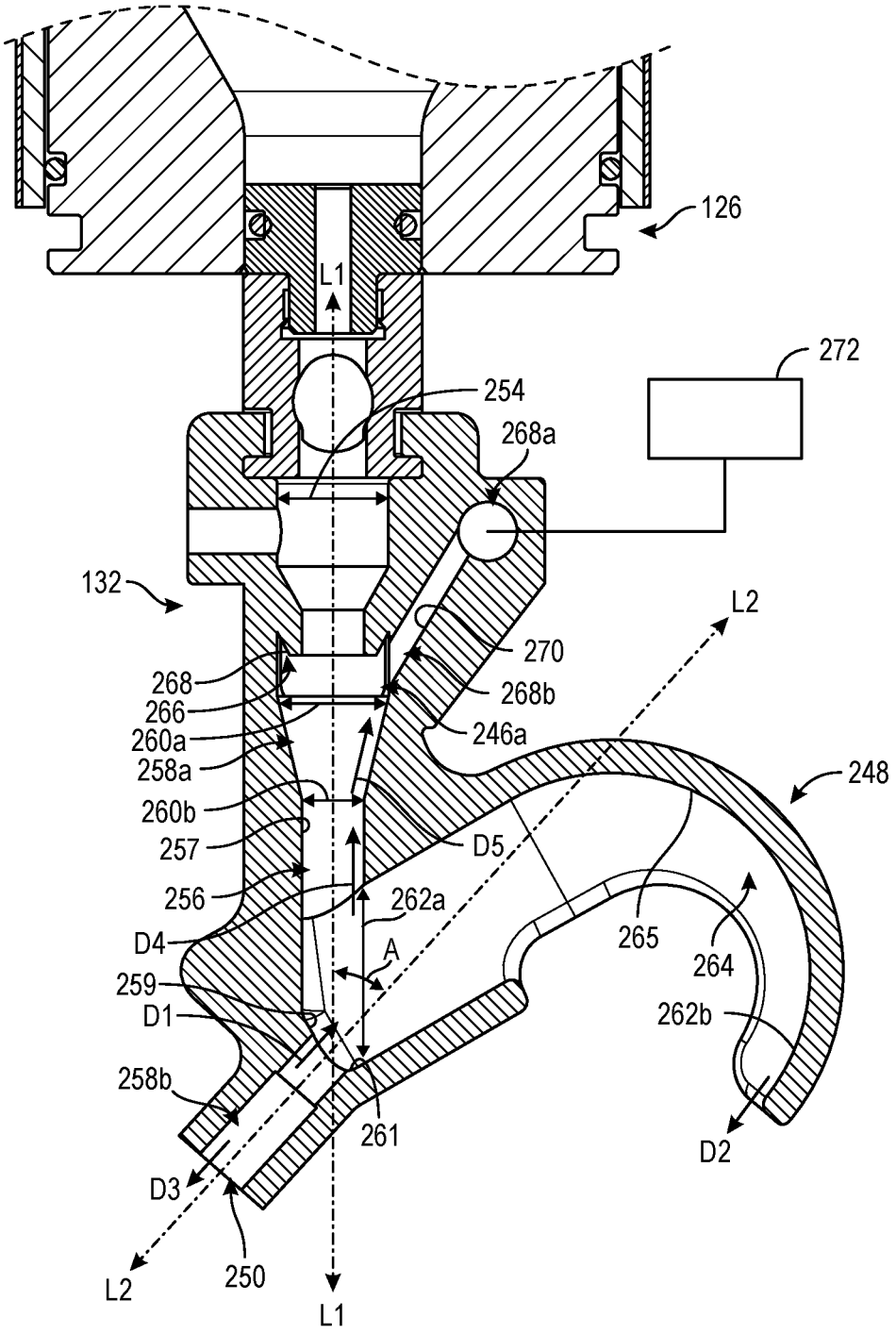
FIG. 2B is a side cross-sectional view of the abrasive feed block of FIG. 2A taken along section line 2B-2B in FIG. 2A.

FIG. 2B is a side cross-sectional view of the feed block 132 taken along section line 2B-2B in FIG. 2A in accordance with embodiments of the present technology. The feed block 132 can include an abrasive inlet 254 positioned upstream from the abrasive outlet 250 and configured to receive abrasive from the hopper 126. An internal passageway 256 can extend through the feed block 132 between the abrasive inlet 254 and the abrasive outlet 250 such that abrasive can flow downstream through the passageway 256 from the abrasive inlet 254 toward and/or through the abrasive outlet 250. The passageway 256 can include an inner surface or sidewall 257, a first or upstream passageway portion 258*a* proximate the abrasive inlet 254, and a second or downstream passageway portion 258*b* proximate the abrasive outlet 250.

Both the first passageway portion 258*a* and the second passageway portion 258*b* can be aligned with a respective longitudinal axis. In the illustrated embodiment, for example, the first passageway portion 258*a* is aligned with a first longitudinal axis L1 and the second passageway portion 258*b* is aligned with a second longitudinal axis L2. The first longitudinal axis L1 and the second longitudinal axis L2 can be positioned at an angle A relative to one another. The angle A can be a non-zero angle, such as an angle of between about 1 degree and about 180 degrees, including at least 10 degrees, 15 degrees, 20 degrees, 25 degrees, 30 degrees, 45 degrees, 60 degrees, 90 degrees, 135 degrees, an angle therebetween, or another suitable angle. For example, in some embodiments the angle A can be between 10 degrees and 80 degrees, between 20 degrees and 70 degrees, or 42 degrees. In these and other embodiments, the angle of the second longitudinal axis L2 relative to the first longitudinal axis L1 can be configured to reduce or prevent backflow received within the second passageway portion 258*b* via the abrasive outlet 250 from entering the first passageway portion 258*a*. For example, because the second longitudinal axis L2 can be at a non-zero angle relative to the first longitudinal axis L1, the second passageway portion 258*b* can direct backflow toward and/or into the backflow diverter 248, bypassing the first passageway portion 258*a*. In some embodiments, a protective and/or hydrophobic coating can be applied to at least a portion of the inner sidewall 257 of the passageway 256 to at least partially or fully prevent absorption of moisture from backflow received by the passageway 256.

The backflow diverter 248 can include a backflow inlet 262*a*, a backflow outlet 262*b*, and a backflow diverter passageway 264 extending therebetween. The backflow inlet 262*a* can be positioned downstream of the abrasive inlet 254 and upstream of the abrasive outlet 250, and can be configured to receive backflow flowing in a first direction D1 upstream and/or away from the abrasive outlet 250. For example, in the illustrated embodiment the axis L2 extends at least partially through the backflow inlet 262*a* and the second passageway portion 258*b* is positioned (e.g., angled) to direct backflow toward and/or through the backflow inlet 262*a*.

In a further aspect of some embodiments, the backflow outlet 262*b* can be configured to discharge the backflow received via the backflow inlet 262*a* away from the feed block 132 in a second direction D2, different than the first direction D1. For example, in some embodiments the backflow diverter passageway 264 can be curved or arcuate such that the backflow diverter 248 redirects the backflow received via the backflow inlet 262*a* in a curved or arcuate path toward the backflow outlet 262*b*. The first direction D1 can be different than (e.g., opposite to) a third direction D3 in which the abrasive outlet 250 is configured to provide abrasive toward the cutting head assembly 104 (FIG. 2A). For example, an angle between the first direction D1 and the third direction D3 can be between about 90 degrees and about 180 degrees, about 120 degrees and about 180 degrees, about 150 degrees and about 180 degrees, or 180 degrees. Additionally or alternatively, an angle between the second direction D2 and the third direction D3 can be between about 0 degrees and about 90 degrees, about 0 degrees and about 60 degrees, about 0 degrees and about 30 degrees, about 0 degrees and about 20 degrees, about 0 degrees and about 10 degrees, or 0 degrees. In these and other embodiments, the backflow diverter 248 can be configured to redirect the backflow toward the base 110 (e.g., the cutting table 130 of the system 100 (FIG. 1). All or a portion of the backflow diverter passageway 264 can have an open cross-sectional shape or open channel shape (e.g. semi-circular or "U" cross-sectional shape), as shown in FIGS. 2A and 2B, configured to allow the backflow diverter 248 to discharge backflow at multiple points along the backflow diverter passageway 264. For example, in the illustrated embodiment, at least the portion of the backflow diverter passageway 264 proximate to the backflow outlet 262*b* includes the open cross-sectional shape. In some embodiments, the portion of the backflow diverter passageway 264 proximate the backflow inlet 262*a* can have a first circular or at least partially circular cross-sectional shape having a first diameter and the abrasive outlet 250 can have a second diameter less than the first diameter. In other embodiments, the portion of the backflow diverter passageway 264 proximate the backflow inlet 262*a* can have a first diameter and the abrasive outlet 250 can have a second diameter equal to or greater than the first diameter.

Each of the spillways 246 (only the first spillway 246*a* is shown in FIG. 2B) can define an opening extending through at least a portion of the inner sidewall 257 of the passageway 256. In some embodiments, at least some or all backflow received via the abrasive outlet 250 is expected to be directed toward and/or into the backflow diverter 248. However, in some instances moisture, liquid (e.g., water and/or steam), and/or other portions of the backflow can wet abrasive within at least a portion of the passageway 256 (e.g., the first passageway portion 258*a*) and thereby cause abrasive build up and/or other backflow that can accumulate within the passageway 256 and/or travel upstream through the passageway 256 and/or toward the abrasive inlet 254, as shown by arrow D4. In these and other embodiments, the spillways 246 can be configured to discharge this backflow and/or other material that travels upstream through the passageway 256 to at least partially or fully prevent this backflow and/or other material from passing through the abrasive inlet 254 and/or entering the hopper 126 and potentially causing a clog. For example, liquid, abrasive, and/or steam that travels upstream through the passageway 256 and/or away from the backflow diverter 248 can be discharged via one or both of the spillways 246 without or substantially without the liquid, abrasive, and/or steam passing upwardly through the abrasive inlet 254 and/or into the hopper 126. This is expected to reduce or prevent abrasive clogs within the abrasive inlet 254 and/or into the hopper 126 and thereby reduce machine downtime associated with removing the backflow. In these and other embodiments, an inner wall 265 of the backflow diverter passageway 264, and/or a portion thereof, can be coated with a protective and/or hydrophobic coating to at least partially or fully prevent absorption of moisture from backflow received by the backflow diverter passageway 264.

In some embodiments, the spillways 246 can be at least partially defined by a diverting pocket 266 formed between the inner sidewall 257 of the passageway 256 and a tapered necked portion 268 (see also FIG. 2A) of the abrasive inlet 254. In these and other embodiments, the first passageway portion 258*a* can be tapered or sloped outwardly away from the first longitudinal axis L1 in an upstream direction. In the illustrated embodiment, for example, the first passageway portion 258*a* includes an upstream end portion 260*a* having a first inner diameter and a downstream end portion 260*b* having a second inner diameter less than the first inner diameter. Without being bound by theory, it is expected that steam and/or other backflow will preferentially travel upstream at the periphery of the first passageway portion 258*a*, as shown by arrow D5. Accordingly, the radially outward upstream taper of the first passageway portion 258*a* can be configured to direct steam and/or other backflow toward and/or into the diverting pocket 266 and/or toward the tapered outer wall portions 273*a-b* (FIG. 2C) of the necked portion 268. The diverting pocket 266 can, in turn, direct the steam and/or other backflow through the spillway 246*a* to at least partially or fully prevent the steam and/or other backflow from passing through the necked portion 268 and/or into the hopper 126. Additionally, or alternatively, the first inner diameter of the upstream end portion 260*a* of the first passageway portion 258*a* can be greater than an outer diameter of a downstream end of the tapered necked portion 268 (see also FIG. 2C), which can prevent, or at least partially prevent, backflow traveling upstream along the periphery of the first passageway portion 258*a* from passing through the necked portion and/or into the hopper 126. As described in greater detail below with reference to FIG. 2C, in some embodiments abrasive flowing downstream from abrasive inlet 254 and encountering a clog in feed block 132 is discharged through the spillways 246 along with steam traveling upstream toward the hopper, preventing or at least partially preventing further upstream travel of moisture and/or other liquid from the backflow.

In some embodiments, the feed block 132 includes a fluid inlet 268*a*, a fluid outlet 268*b*, and a fluid passageway 270 extending therebetween. The fluid inlet 268*a* can be configured to receive high-pressure fluid, such as pressurized air, from a fluid source 272. The fluid outlet 268*b* can be configured to discharge the high-pressure fluid into the passageway 256 to at least partially or fully dislodge backflow from within at least a portion of the passageway 256, such as one or more dry portions of the passageway 256, such as the first passageway portion 258*a* and/or the second passageway portion 258*b*. The fluid passageway 270 can be positioned at a non-zero angle relative to the passageway 256. In the illustrated embodiment the fluid passageway 270 is angled radially inward toward the first longitudinal axis L1 in a downstream direction from the fluid inlet 268*a* to the fluid outlet 268*b*, such that the fluid passageway 270 is configured to direct high-pressure fluid in a downstream direction through at least a portion of the passageway 256, toward the abrasive outlet 250 and/or away from the abrasive inlet 254.

In some embodiments, the feed block 132 includes an abrasive diverting ridge portion 259 extending inwardly from an inner surface of the passageway 256. In the illustrated embodiment, the ridge portion 259 is positioned proximate the second passageway portion 258*b* and on an opposite side of the first longitudinal axis L1 from the backflow inlet 262*a*. In other embodiments, the ridge portion 259 can have other suitable positions, and in further embodiments the ridge portion 259 can be omitted. The ridge portion 259 can be configured to prevent or at least partially preventing abrasive flowing downstream through the passageway 256 from falling directly into the second passageway portion 258*b*. Instead, abrasive flowing downstream through the passageway 256 can contact the ridge portion 259 and be redirected/deflected inwardly, such as toward the backflow inlet 262*a*, before entering the second passageway portion 258*b* and flowing toward the abrasive outlet 250. Additionally or alternatively, because the ridge portion 259 extends into the passageway 256, the ridge portion 259 can direct backflow received via the abrasive outlet 250 toward and/or into the backflow inlet 262*a*, as shown by the arrow D1, to prevent, or at least partially prevent, backflow received via the abrasive outlet 250 from traveling upstream through the passageway 256.

In these and other embodiments, the feed block 132 can include a lip portion 261. In the illustrated embodiment, the lip portion 261 is positioned on an opposite side of the first longitudinal axis L1 from the ridge portion 259, at least partially between the second passageway portion 258*b* and the backflow inlet 262*a*. In other embodiments, the lip portion 261 can have other suitable positions, and in further embodiments the lip portion 261 can be omitted. The lip portion 261 can be configured to prevent, or at least partially prevent, abrasive flowing downstream through the passageway 256 from falling directly into the second passageway portion 258*b*. For example, at least some abrasive flowing downstream through the passageway can contact the lip portion 261 before entering the second passageway portion 258*b*. In these and other embodiments, the lip portion 261 can be positioned to receive at least a portion of the abrasive redirected by the ridge portion 259, such that at least some abrasive flowing downstream through passageway 256 can be redirected by the ridge portion 259 toward the lip portion 261 before entering the second passageway portion 258*b* and flowing toward the abrasive outlet 250.

Figure 2C:
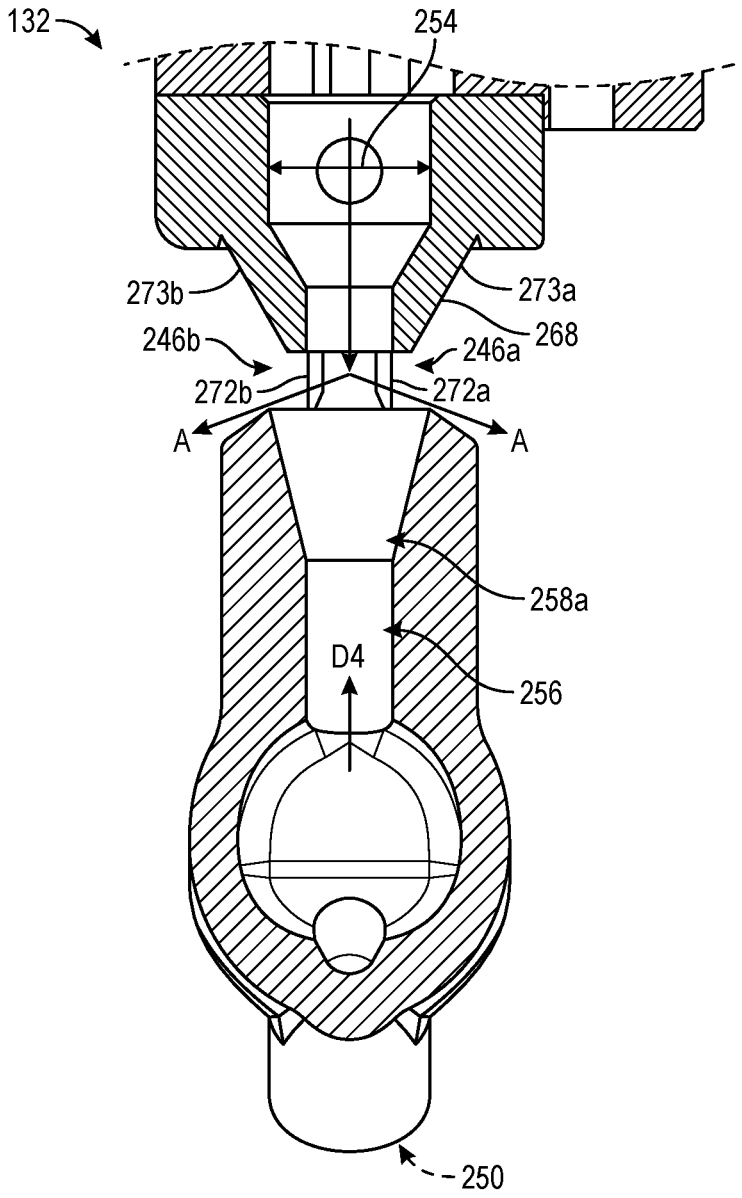
FIG. 2C is a side cross-sectional view of the abrasive feed block of FIG. 2A taken along section line 2C-2C in FIG. 2A.

FIG. 2C is a side cross-sectional view of the feed block 132 taken along section line 2C-2C of FIG. 2A. As best shown in FIG. 2C, the first spillway 246*a* can be formed through a first side portion 272*a* of the feed block 132 and the second spillway 246*b* can be formed through a second side portion 272*b* of the feed block 132. In the illustrated embodiment the first spillway 246*a* is opposite the second spillway 246*b*. In other embodiments, the first spillway 246*a* and/or the second spillway 246*b* can have other suitable positions relative to each another, one or both of the spillways 246 may be omitted, or the feed block 132 can include 3 or more spillways.

In some embodiments, the spillways 246 can be configured to discharge abrasive received via the abrasive inlet 254 (e.g., from the abrasive source 127; FIG. 1) when at least a portion of the passageway 256 is blocked or clogged, e.g., by backflow or other material. For example, moisture and/or other liquid from backflow traveling upstream from the abrasive outlet 250 (e.g., as shown by arrow D4) can enter the first passageway portion 258*a*, wet any abrasive contained therein, and thereby cause the abrasive to build up within the first passageway portion 258*a* and thereby at least partially or fully block or clog downstream abrasive flow through the first passageway portion 258*a*. Accordingly, continued downstream abrasive flow can increase the size of the clog in the first passageway portion 258*a* until the clog reaches the spillways 246. At this point, the clog in the first passageway portion 258*a* can cause abrasive flowing downstream from the abrasive inlet 254 to be discharged from the feed block 132 via the spillways 246, as shown by arrows A. Without being bound by theory, in some embodiments the flow rate of abrasive through the spillways 246 is expected to be equal to or greater than the rate at which moisture and/or other liquid from the clog in the first passageway portion can wick upstream through the downstream-flowing abrasive, such that the moisture and/or other liquid from the backflow can be prevented from passing through the abrasive inlet 254 and/or entering the hopper 126. As such, abrasive contained within the hopper 126 is expected to remain at least partially or fully dry and/or otherwise free from the moisture and/or other liquid from the backflow.

In some embodiments, the feed block 132 can be formed from one or more non-metallic material(s) such as nylon, polytetrafluoroethylene ("PTFE"), graphite, carbon fiber, other suitable polymers, and/or other suitable non-metallic materials. For example, in at least some embodiments the feed block 132 is formed from black nylon 3Al2. Additionally or alternatively, the feed block 132 can be formed from one or more metallic materials (e.g., metals), such as stainless steel, titanium, and/other suitable metallic materials. In these and other embodiments, the feed block 132 can be formed using one or more additive manufacturing techniques (e.g., 3D printing, injection molding, etc.), machined from one or more materials, and/or formed using other suitable manufacturing processes and/or techniques.

Figure 3A:
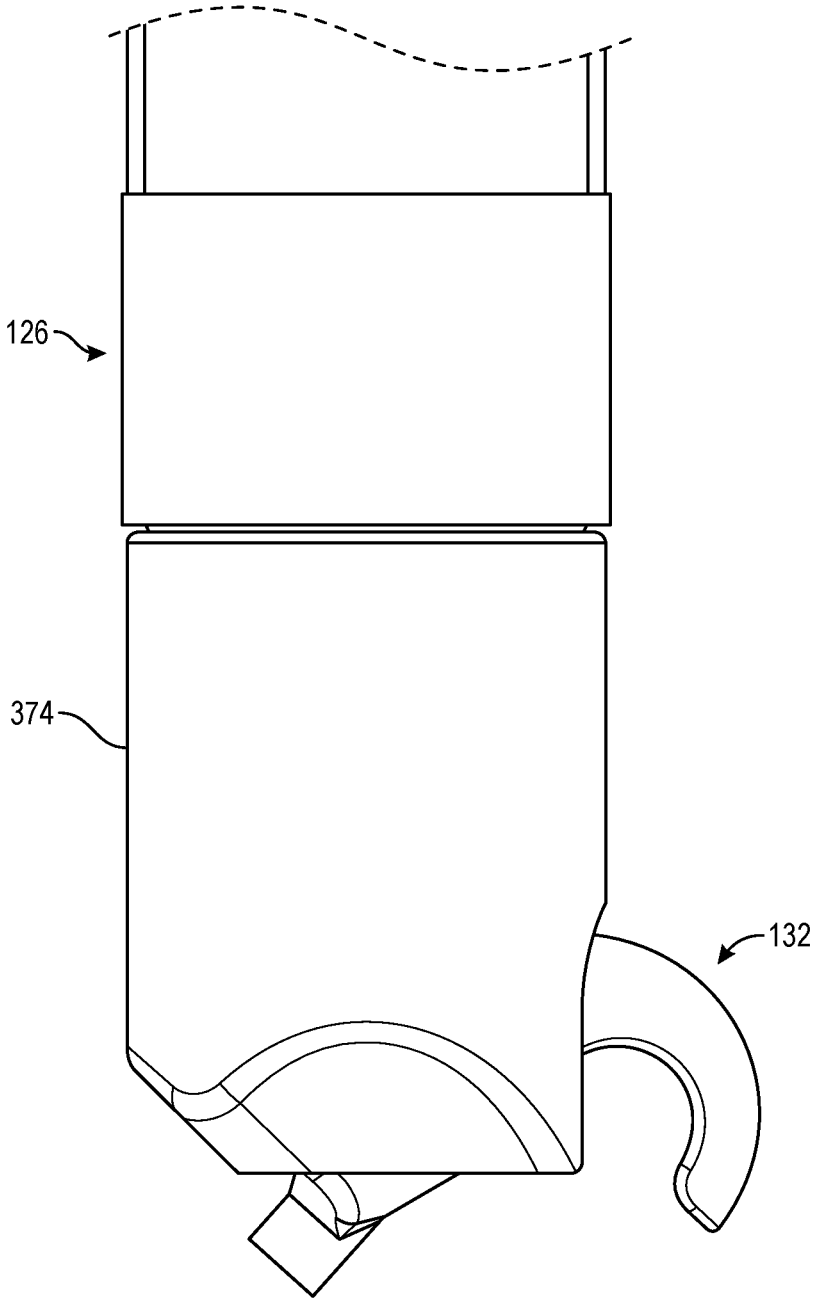
FIG. 3A is a perspective view of the abrasive feed block of FIG. 2A and a feed block cover configured in accordance with embodiments of the present technology.
Figure 3B:
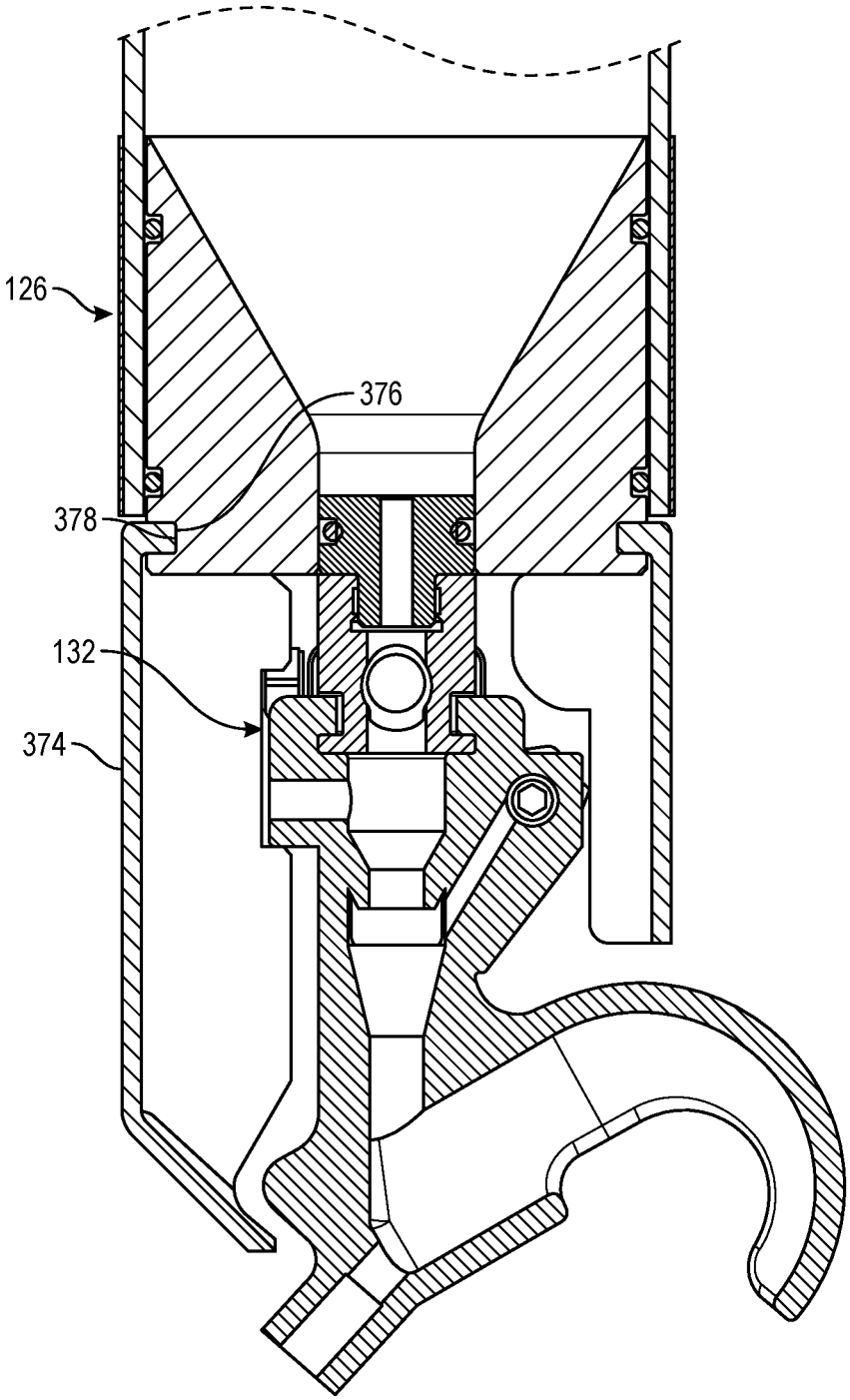
FIG. 3B is a side cross-sectional view of the abrasive feed block and the feed block cover of FIG. 3A.

FIG. 3A is a perspective view of the feed block 132 and a feed block cover 374 configured in accordance with embodiments of the present technology. FIG. 3B is a side cross-sectional view of the feed block 132 and the feed block cover 374 in FIG. 3A. Referring to FIGS. 3A and 3B together, in some embodiments, the feed block cover 374 can be positioned at least partially or fully around the feed block 132 to at least partially or fully prevent inadvertent interference with and/or damage to the feed block 132, such as during operation thereof. The feed block cover 374 can be configured to be releasably coupled to the hopper 126, such that the covering can be removed to clean and/or perform other maintenance upon the feed block 132. Referring to FIG. 3B, for example, the feed block cover 374 includes one or more tabs 376 configured to be slidably received by corresponding slots 378 in the hopper 126.

EXAMPLES

Several aspects of the present technology are described with reference to the following examples:

1. A device for providing abrasive to a cutting head in a liquid jet cutting system, the device comprising:
   an abrasive inlet configured to receive abrasive;
   an abrasive outlet downstream from the abrasive inlet and configured to discharge the abrasive; and
   a backflow diverter including—
      a backflow inlet positioned downstream of the abrasive inlet and upstream of the abrasive outlet, wherein the backflow inlet is configured to receive backflow flowing away from the abrasive outlet in a first direction, the backflow including abrasive, steam, and/or liquid; and
      a backflow outlet configured to discharge the backflow away from the backflow diverter in a second direction, different than the first direction.

2. The device of example 1 wherein the backflow includes abrasive and/or liquid traveling in an upstream direction.

3. The device of example 1 or example 2 wherein the abrasive outlet is configured to discharge abrasive in a third direction toward a cutting head feed port, and wherein an angle between the second direction and the third direction is between 0 and 90 degrees inclusive.

4. The device of any of examples 1-3 wherein the abrasive outlet is configured to discharge abrasive in a third direction toward a cutting head feed port, and wherein an angle between the first direction and the third direction is between 90 and 180 degrees inclusive.

5. The device of any of examples 1-4, wherein a passageway extends between the abrasive inlet and the abrasive outlet, wherein the passageway includes a first passageway portion proximate the abrasive inlet and a second passageway portion proximate the abrasive outlet, wherein the first passageway portion is aligned with a first longitudinal axis and the second passageway portion is aligned with a second longitudinal axis, and wherein the second longitudinal axis is positioned at a non-zero angle relative to the first longitudinal axis and configured to direct backflow toward the backflow inlet of the backflow diverter.

6. The device of any of examples 1-5 wherein the backflow inlet has a first diameter and the abrasive outlet has a second diameter, less than the first diameter.

7. The device of any of examples 1-6, wherein a first passageway extends between the abrasive inlet and the abrasive outlet, the first passageway having a first inner wall, wherein a second passageway extends between the backflow inlet and the backflow outlet, the second passageway having a second inner wall, and wherein the device further comprises a protective coating covering at least a portion the first inner wall and/or a portion of the second inner wall, wherein the protective coating is configured to at least partially prevent absorption of moisture from the backflow.

8. The device of any of examples 1-7, wherein the liquid jet cutting system includes a cutting table downstream from the abrasive outlet, wherein the backflow diverter is configured to redirect the backflow toward the cutting table.

9. The device of any of examples 1-8 wherein the backflow diverter is configured to direct the backflow received via the backflow inlet in a curved path toward the backflow outlet.

10. The device of any of examples 1-9 wherein the backflow diverter is configured to direct the backflow received via the backflow inlet in an arcuate path toward the backflow outlet.

11. The device of any of examples 1-10 wherein the backflow diverter includes an open cross-sectional shape proximate the backflow outlet.

12. The device of any of examples 1-11, wherein a passageway extends between the abrasive inlet and the abrasive outlet, wherein the passageway includes at least one spillway positioned upstream of the backflow inlet, and wherein the at least one spillway is configured to discharge at least a portion of the backflow.

13. The device of example 12 wherein the passageway includes an inner wall, and wherein the at least one spillway includes an opening in the inner wall configured to discharge the abrasive received from the abrasive inlet when a portion of the passageway downstream of the at least one spillway is blocked.

14. The device of example 13 wherein a portion of the inner wall downstream of the at least one spillway is tapered radially outwardly in an upstream direction.

15. A device for providing abrasive to a cutting head in a high-pressure liquid jet cutting system, the device comprising:
   an abrasive inlet configured to receive abrasive;
   an abrasive outlet downstream from the abrasive inlet and configured to discharge the abrasive;
   a backflow diverter positioned downstream of the abrasive inlet and upstream of the abrasive outlet, wherein the backflow diverter is configured to receive at least a first portion of backflow flowing away from the abrasive outlet and discharge the first portion of backflow, the backflow including abrasive, steam, and/or liquid; and
   at least one spillway positioned downstream of the abrasive inlet and upstream of the backflow diverter, wherein the at least one spillway is configured to discharge abrasive flowing from the abrasive inlet and/or at least a second portion of backflow flowing away from the backflow diverter.

16. The device of example 15 wherein the abrasive inlet is configured to receive the abrasive from an abrasive source, and wherein the abrasive outlet is configured to discharge the abrasive toward a cutting head feed port.

17. The device of example 16 wherein the at least one spillway is configured to discharge at least the abrasive flowing from the abrasive inlet to at least partially prevent moisture from the second portion of backflow from traveling upstream into the abrasive source.

18. The device of any of examples 15-17, wherein a passageway extends between the abrasive inlet and the abrasive outlet, and wherein the at least one spillway includes an opening extending through a sidewall portion of the passageway.

19. The device of example 18 wherein the sidewall portion is a first sidewall portion and the at least one spillway is a first spillway, and wherein the device further includes a second spillway extending through a second sidewall portion of the passageway.

20. The device of example 19 wherein the first spillway is positioned opposite the second spillway.

21. The device of any of examples 18-20 wherein the at least one spillway is configured to discharge the abrasive flowing from the abrasive inlet when the passageway is at least partially filled with the backflow flowing upstream from the abrasive outlet.

22. The device of any of examples 18-21 wherein the passageway includes a first passageway portion proximate the abrasive inlet and a second passageway portion proximate the abrasive outlet, wherein the first passageway portion includes an upstream end portion having a first diameter and a downstream end portion having a second diameter less than the first diameter.

23. A device for providing abrasive to a cutting head in a high-pressure liquid jet cutting system, the device comprising:

an abrasive inlet configured to receive abrasive;

an abrasive outlet downstream from the abrasive inlet and configured to discharge the abrasive;

a first passageway configured to convey the abrasive between the abrasive inlet and the abrasive outlet; and a second passageway having a fluid inlet configured to receive high-pressure fluid and a fluid outlet configured to discharge the high-pressure fluid into the first passageway to at least partially dislodge abrasive backflow from within at least a portion of the first passageway.

24. The device of example 23 wherein the high-pressure fluid includes pressurized air.

25. The device of example 23 or example 24 wherein the second passageway is positioned at a non-zero angle relative to the first passageway.

26. The device of any of examples 23-25 wherein the second passageway is configured to direct the high-pressure fluid in a downstream direction through at least a portion of the first passageway toward the abrasive outlet.

27. The device of any of examples 23-26 wherein the second passageway is configured to direct the high-pressure fluid in a downstream direction through at least a portion of the first passageway away from the abrasive inlet.

28. The device of any of examples 23-27 further comprising a backflow diverter positioned downstream of the abrasive inlet and upstream of the abrasive outlet, wherein the backflow diverter is configured to receive backflow flowing away from the abrasive outlet and discharge at least a portion of the backflow, the portion of the backflow including abrasive and/or liquid.

29. The device of example 28 wherein the backflow diverter defines a curved backflow path.

30. The device of example 28 or example 29 wherein the backflow diverter includes a backflow inlet configured to receive the portion of the backflow flowing away from the abrasive outlet and a backflow outlet configured to discharge the portion of the backflow, wherein the backflow diverter is configured to direct the portion of the backflow received via the backflow inlet in an arcuate path toward the backflow outlet.

31. The device of any of examples 28-30 wherein the portion of the backflow is a first portion of backflow flowing away from the abrasive outlet, and wherein the device further comprises at least one spillway positioned downstream of the abrasive inlet and upstream of the backflow diverter, wherein the at least one spillway is configured to discharge abrasive flowing from the abrasive inlet and/or at least a second portion of backflow flowing away from the abrasive outlet.

32. The device of example 31 further comprising a passageway configured to direct abrasive from the abrasive inlet toward the abrasive outlet, wherein the at least one spillway is formed in a sidewall of the passageway.

33. The device of example 32 wherein at least a portion of the passageway downstream from the at least one spillway is tapered radially inwardly in a downstream direction.

34. A method of diverting abrasive backflow from a cutting head in a liquid jet cutting system, the method comprising:

flowing abrasive through a feed block toward the cutting head, wherein the feed block includes— a first backflow diverter, and a second backflow diverter positioned downstream from the first backflow diverter;

discharging a first portion of backflow from the feed block via the second backflow diverter, wherein the first portion of backflow includes abrasive and/or liquid; and discharging a second portion of backflow from the feed block via the first backflow diverter, wherein the second portion of backflow includes steam.

35. The method of example 34, further comprising directing high-pressure fluid through at least a portion of the feed block to at least partially dislodge the first portion of backflow from within the second backflow diverter and/or at least partially dislodge the second portion of backflow from within the first backflow diverter.

36. The method of example 34 or example 35 wherein flowing abrasive through the feed block includes flowing the abrasive while the first portion of backflow is being discharged via the second backflow diverter.

37. The method of any of example 34-46 wherein flowing the abrasive includes flowing while the second portion of backflow is being discharged via the first backflow diverter.

38. The method of any of examples 34-37 wherein at least one of (i) discharging the first portion of backflow and/or (ii) discharging the second portion of backflow includes automatically discharging the respective first and/or second portion of backflow.

39. The method of any of examples 34-38 wherein at least one of (i) discharging the first portion of backflow and/or (ii) discharging the second portion of backflow includes discharging the respective first and/or second portion of backflow while maintaining a configuration of the feed block.

This disclosure is not intended to be exhaustive or to limit the present technology to the precise forms disclosed herein. Although specific embodiments are disclosed herein for illustrative purposes, various equivalent modifications are possible without deviating from the present technology, as those of ordinary skill in the relevant art will recognize. In some cases, well-known structures and functions have not been shown and/or described in detail to avoid unnecessarily obscuring the description of the embodiments of the present technology. Although steps of methods may be presented herein in a particular order, in alternative embodiments the steps may have another suitable order. Similarly, certain aspects of the present technology disclosed in the context of particular embodiments can be combined or eliminated in other embodiments. Furthermore, while advantages associated with certain embodiments may have been disclosed in the context of those embodiments, other embodiments may also exhibit such advantages, and not all embodiments need necessarily exhibit such advantages or other advantages disclosed herein to fall within the scope of the present technology.

Certain aspects of the present technology may take the form of computer-executable instructions, including routines executed by the computing device 120. In some embodiments, the computing device 120 is specifically programmed, configured, or constructed to perform one or more of these computer-executable instructions. Furthermore, some aspects of the present technology may take the form of data (e.g., non-transitory data) stored on the memory 136 or stored or distributed on other computer-readable media, including magnetic or optically readable or removable computer discs as well as media distributed electronically over networks. Accordingly, data structures and transmissions of data particular to aspects of the present technology are encompassed within the scope of the present technology. The present technology also encompasses methods of both programming computer-readable media to perform particular steps and executing the steps.

Throughout this disclosure, the singular terms "a," "an," and "the" include plural referents unless the context clearly indicates otherwise. Similarly, unless the word "or" is expressly limited to mean only a single item exclusive from the other items in reference to a list of two or more items, then the use of "or" in such a list is to be interpreted as including (a) any single item in the list, (b) all of the items in the list, or (c) any combination of the items in the list. Additionally, the terms "comprising" and the like may be used herein to mean including at least the recited feature(s) such that any greater number of the same feature(s) and/or one or more additional types of features are not precluded. Directional terms, such as "upper," "lower," "front," "back," "vertical," and "horizontal," may be used herein to express and clarify the relationship between various elements. It should be understood that such terms do not denote absolute orientation. Reference herein to "one embodiment," "an embodiment," or similar formulations means that a particular feature, structure, operation, or characteristic described in connection with the embodiment can be included in at least one embodiment of the present technology. Thus, the appearances of such phrases or formulations herein are not all referring to the same embodiment. Furthermore, various particular features, structures, operations, or characteristics may be combined in any suitable manner in one or more embodiments of the present technology.

We claim:

1. A device for providing abrasive to a cutting head in a high-pressure liquid jet cutting system, the device comprising:

an abrasive inlet configured to receive abrasive from an abrasive hopper;

an abrasive outlet downstream from the abrasive inlet and configured to discharge the abrasive;

a backflow diverter positioned downstream of the abrasive inlet and upstream of the abrasive outlet, wherein the backflow diverter is configured to receive at least a first portion of backflow flowing away from the abrasive outlet and discharge the first portion of backflow, the backflow including abrasive, steam, and/or liquid; and at least one spillway positioned downstream of the abrasive inlet and upstream of the backflow diverter, wherein the at least one spillway is configured to discharge abrasive flowing from the abrasive inlet and/or at least a second portion of backflow flowing away from the backflow diverter, wherein the abrasive inlet, the abrasive outlet, the backflow diverter, and the at least one spillway are features of a unitary structure configured to be coupled to the abrasive hopper to receive the abrasive therefrom.

2. The device of claim 1 wherein the abrasive inlet is configured to receive the abrasive from an abrasive source, and wherein the abrasive outlet is configured to discharge the abrasive toward a cutting head feed port.

3. The device of claim 2 wherein the at least one spillway is configured to discharge at least the abrasive flowing from the abrasive inlet to at least partially prevent moisture from the second portion of backflow from traveling upstream into the abrasive source.

4. The device of claim 1, wherein a passageway extends between the abrasive inlet and the abrasive outlet, and wherein the at least one spillway includes an opening extending through a sidewall portion of the passageway.

5. The device of claim 4 wherein the sidewall portion is a first sidewall portion and the at least one spillway is a first spillway, and wherein the device further includes a second spillway extending through a second sidewall portion of the passageway.

6. The device of claim 5 wherein the first spillway is positioned opposite the second spillway.

7. The device of claim 4 wherein the at least one spillway is configured to discharge the abrasive flowing from the abrasive inlet when the passageway is at least partially filled with the backflow flowing upstream from the abrasive outlet.

8. The device of claim 4 wherein the passageway includes a first passageway portion proximate the abrasive inlet and a second passageway portion proximate the abrasive outlet, wherein the first passageway portion includes an upstream end portion having a first diameter and a downstream end portion having a second diameter less than the first diameter.

9. The device of claim 1 wherein the abrasive outlet is configured to discharge the abrasive toward a cutting head feed port of the high-pressure liquid jet cutting system.

10. The device of claim 1, further comprising a passageway extending between the abrasive inlet and the abrasive outlet, wherein the passageway includes a first passageway portion proximate the abrasive inlet and a second passageway portion proximate the abrasive outlet, wherein the first passageway portion is aligned with a first longitudinal axis and the second passageway portion is aligned with a second longitudinal axis, and wherein the second longitudinal axis is positioned at a non-zero angle relative to the first longitudinal axis and configured to direct at least the first portion of backflow toward the backflow diverter.

11. The device of claim 1 wherein the backflow diverter includes a backflow inlet configured to receive the first portion of backflow and a backflow outlet configured to discharge the first portion of backflow, wherein the backflow inlet has a first diameter, and wherein the abrasive outlet has a second diameter, less than the first diameter.

12. The device of claim 1, wherein a first passageway extends between the abrasive inlet and the abrasive outlet, the first passageway having a first inner wall, wherein a second passageway extends between an inlet of the backflow diverter and an outlet of the backflow diverter, the second passageway having a second inner wall, and wherein the device further comprises a protective coating covering at least a first portion of the first inner wall and/or at least a second portion of the second inner wall, wherein the protective coating is configured to at least partially prevent absorption of moisture from the backflow.

13. The device of claim 1, wherein the high-pressure liquid jet cutting system includes a cutting table downstream from the abrasive outlet, wherein the backflow diverter is configured to redirect the first portion of backflow toward the cutting table.

14. The device of claim 1 wherein the backflow diverter includes a backflow inlet configured to receive the first portion of backflow and a backflow outlet configured to discharge the first portion of backflow, and wherein the backflow diverter is configured to direct the first portion of backflow received via the backflow inlet in a curved path toward the backflow outlet.

15. The device of claim 1 wherein the backflow diverter includes a backflow inlet configured to receive the first portion of backflow and a backflow outlet configured to discharge the first portion of backflow, and wherein the backflow diverter is configured to direct the backflow received via the backflow inlet in an arcuate path toward the backflow outlet.

16. The device of claim 1 wherein the backflow diverter includes a backflow inlet configured to receive the first portion of backflow and a backflow outlet configured to discharge the first portion of backflow, and wherein the backflow diverter further includes an open cross-sectional shape proximate the backflow outlet.

17. A device for providing abrasive to a cutting head in a high-pressure liquid jet cutting system, the device comprising:

an abrasive inlet configured to receive abrasive;

an abrasive outlet downstream from the abrasive inlet and configured to discharge the abrasive;

a first passageway configured to convey the abrasive between the abrasive inlet and the abrasive outlet; and a second passageway having a fluid inlet configured to receive high-pressure fluid and a fluid outlet positioned at an elevation below the fluid inlet and configured to discharge the high-pressure fluid into a portion of the first passageway in a downstream direction angled relative to the portion of the first passageway to at least partially dislodge abrasive backflow from within the first passageway.

18. The device of claim 17 wherein the high-pressure fluid includes pressurized air.

19. The device of claim 17 wherein the second passageway is positioned at a non-zero angle relative to the first passageway.

20. The device of claim 17 wherein the second passageway is configured to direct the high-pressure fluid in a downstream direction through at least a portion of the first passageway toward the abrasive outlet.

21. The device of claim 17 wherein the second passageway is configured to direct the high-pressure fluid in a downstream direction through at least a portion of the first passageway away from the abrasive inlet.

22. The device of claim 17 further comprising a backflow diverter positioned downstream of the abrasive inlet and upstream of the abrasive outlet, wherein the backflow diverter is configured to receive backflow flowing away from the abrasive outlet and discharge at least a portion of the backflow, the portion of the backflow including abrasive and/or liquid.

23. The device of claim 22 wherein the backflow diverter defines a curved backflow path.

24. The device of claim 22 wherein the backflow diverter includes a backflow inlet configured to receive the portion of the backflow flowing away from the abrasive outlet and a backflow outlet configured to discharge the portion of the backflow, wherein the backflow diverter is configured to direct the portion of the backflow received via the backflow inlet in an arcuate path toward the backflow outlet.

25. The device of claim 22 wherein the portion of the backflow is a first portion of backflow flowing away from the abrasive outlet, and wherein the device further comprises at least one spillway positioned downstream of the abrasive inlet and upstream of the backflow diverter, wherein the at least one spillway is configured to discharge abrasive flowing from the abrasive inlet and/or at least a second portion of backflow flowing away from the abrasive outlet.

26. The device of claim 25 wherein the at least one spillway is formed in a sidewall of the first passageway.

27. The device of claim 26 wherein at least a portion of the first passageway downstream from the at least one spillway is tapered radially inwardly in a downstream direction.

28. The device of claim 17 wherein the abrasive outlet is configured to discharge the abrasive toward a cutting head feed port of the high-pressure liquid jet cutting system.

29. The device of claim 17, wherein the first passageway includes at least one spillway positioned downstream from the abrasive inlet, and wherein the at least one spillway is configured to discharge at least a portion of the abrasive backflow.

30. The device of claim 29 wherein the first passageway includes an inner wall, and wherein the at least one spillway includes an opening in the inner wall configured to discharge the abrasive received from the abrasive inlet when a portion of the first passageway downstream of the at least one spillway is blocked.

31. The device of claim 30 wherein a portion of the inner wall downstream of the at least one spillway is tapered radially outwardly in an upstream direction.

* * * * *